US006666143B1

(12) United States Patent
Collins

(10) Patent No.: US 6,666,143 B1
(45) Date of Patent: Dec. 23, 2003

(54) OBSCURANT DEVICE

(75) Inventor: Peter John David Collins, Salisbury (GB)

(73) Assignee: The Secretary of State for Defence in Her Britannic Majesty's Government of the United Kingdom of Great Britain and Northern Ireland (GB)

( * ) Notice: Subject to any disclaimer, the term of this patent is extended or adjusted under 35 U.S.C. 154(b) by 0 days.

(21) Appl. No.: 10/088,702

(22) PCT Filed: Aug. 21, 2000

(86) PCT No.: PCT/GB00/03209

§ 371 (c)(1),
(2), (4) Date: Jul. 26, 2002

(87) PCT Pub. No.: WO01/22027

PCT Pub. Date: Mar. 29, 2001

(30) Foreign Application Priority Data

Sep. 23, 1999 (GB) ..... 9922493

(51) Int. Cl.[7] ..... F42B 12/48; F42B 12/50
(52) U.S. Cl. ..... 102/334; 102/336; 102/351
(58) Field of Search ..... 102/334, 336, 102/351

(56) References Cited

U.S. PATENT DOCUMENTS

| | | | | | |
|---|---|---|---|---|---|
| 4,697,521 | A | | 10/1987 | Espangnacq et al. | 102/334 |
| 4,726,295 | A | | 2/1988 | Embury, Jr. et al. | 102/334 |
| 4,841,865 | A | * | 6/1989 | Liberman | 102/334 |
| 5,148,173 | A | * | 9/1992 | Rouse et al. | 342/3 |
| 5,337,671 | A | * | 8/1994 | Varmo | 102/334 |
| 5,585,594 | A | * | 12/1996 | Pelham et al. | 102/336 |
| 5,656,794 | A | * | 8/1997 | Krone et al. | 102/334 |
| 5,659,147 | A | | 8/1997 | Rouse et al. | 102/351 X |
| 5,661,257 | A | * | 8/1997 | Nielson et al. | 102/334 |
| 5,682,010 | A | | 10/1997 | Embury, Jr. | 102/334 |
| 5,872,325 | A | | 2/1999 | Feldmeier et al. | 102/334 |
| 6,013,144 | A | * | 1/2000 | Callaway | 102/336 |
| 6,386,110 | B1 | * | 5/2002 | Landman et al. | 102/331 |

FOREIGN PATENT DOCUMENTS

| | | |
|---|---|---|
| DE | 19602422 | 6/1997 |
| WO | WO 92/13251 | 8/1992 |

* cited by examiner

*Primary Examiner*—Peter A. Nelson
(74) *Attorney, Agent, or Firm*—Dean W. Russell; Kilpatrick Stockton LLP

(57) ABSTRACT

Many of today's weapons systems use surveillance and target acquisition (STA) devices which can exploit the infrared and millimeter wavebands of the electromagnetic spectrum. Designing obscurant devices which can provide screening against such systems often results in complicated or costly solutions. A device capable of mitigating these problems is described wherein an obscurant device (10), and more particularly a device capable of providing screening against the visual, infrared and millimeter wave regions of the electromagnetic spectrum, comprises an obscurant payload, a burster charge capable, when detonated by a detonator, of disseminating said payload and a payload casing wherein some or all of the payload casing is configured to disintegrate upon actuation of the burster charge and to act thereafter as an obscurant.

16 Claims, 5 Drawing Sheets

OBSCURANT DEVICE

Figure 1:
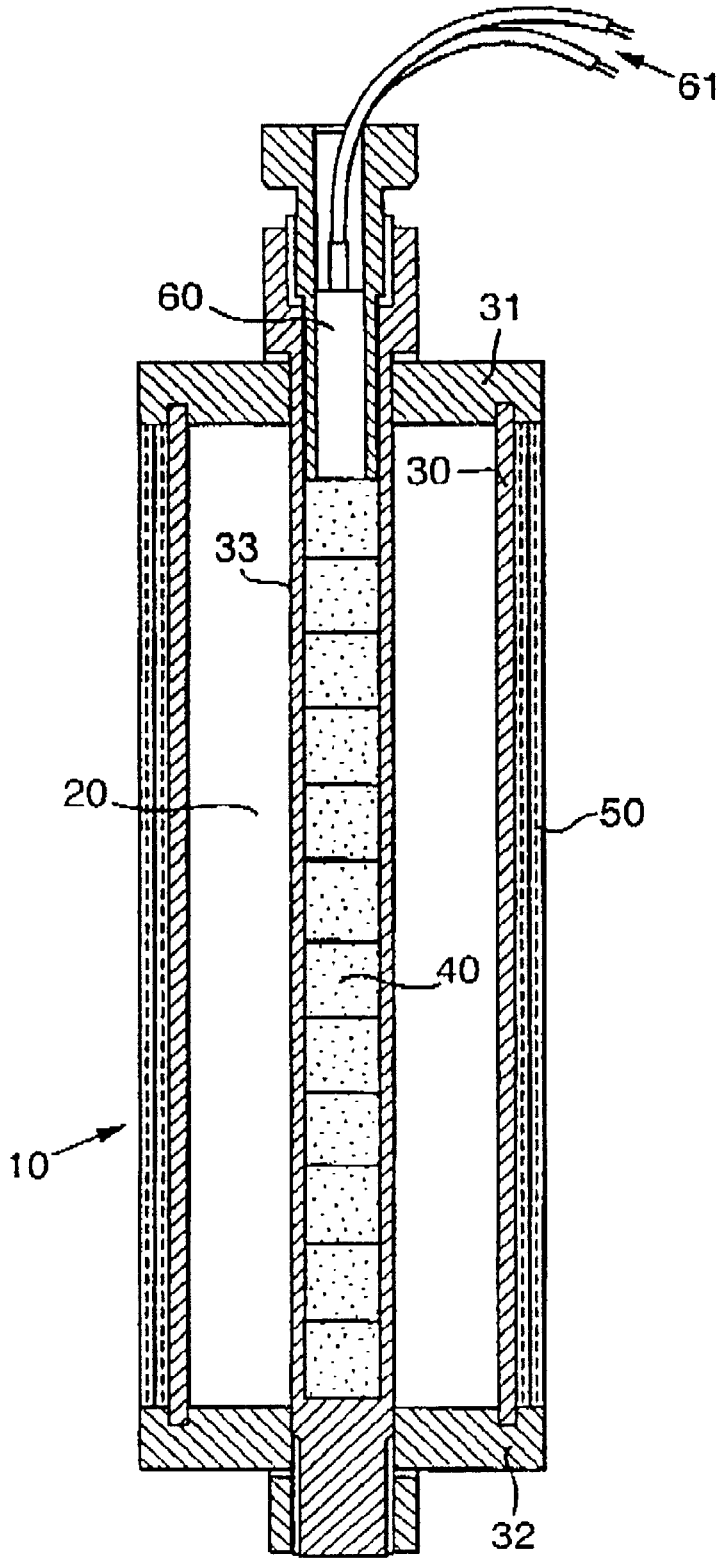

This application claims priority to Great Britain Application No. 9922493.3 filed on Sep. 23, 1999 and International Application No. PCT/GB00/03209 filed on Aug. 21, 2000 and published in English as International Publication Number WO 01/22027 A1 on Mar. 29, 2001.

The present invention relates to obscurant devices and more particularly to those capable of providing screening against the visual, infrared and millimeter wave regions of the electromagnetic spectrum.

It has long been a desire to increase the survivability of friendly forces in battle by screening them from enemy sensors. Historically, smoke has been used to achieve this aim. However, advances in the field of sensor technology has increased the effectiveness of many weapons systems by equipping them with surveillance and target acquisition (STA) devices which can exploit the infrared and millimeter wavebands of the electromagnetic spectrum. Longer wavelength radiation is readily transmitted through conventional visual obscurant screens thereby exposing friendly forces to greater risks.

Research has shown that there is currently no single material that is capable of screening effectively at visual, infrared and millimeter wavelengths. Since obscurant materials screen radiation whose wavelength is roughly equal to their particle size it is highly improbable that a single material capable of screening across the millimeter to infrared range will be developed in the near future. In order, therefore, to provide protection against STA devices it is necessary to deploy a mixture of obscurants, for example powders, fibres and pyrotechnic compositions, from a single munition.

There is currently no "commercial off the shelf" device which comprises a mixture of components designed to counter STA devices. However, a design for such a device was disclosed in the Smoke/obscurants Symposium, Apr. 28–30, 1998, Aberdeen Proving Ground, Maryland, USA; The Evolution of a Design for a Rapid Bloom Multi -Spectral obscurant Munition by P J D Collins, J M B Christofi, N Davies and D Green. A disadvantage of this design is that it would tend to be relatively large and complex and therefore expensive to manufacture. A further disadvantage of this device is that the munition has a section with a calibre that is larger than the standard US and UK calibre.

The only known millimeter wave screening munition is the United States M81 66 millimeter grenade (NATO Classification; Grenade Launcher Smoke: MM/IR screening M81). A disadvantage of this grenade is that, although the design is capable of carrying some infrared screening payload, it is optimised for performance in the millimeter waveband. In practice, in order to achieve multi-spectral screening the US require the use of a number of different obscurant devices, e.g. one for infrared screening, one for visual screening and one (the M81) for millimeter screening.

It is therefore an object of the present invention to provide an obscurant device which alleviates some of the above disadvantages by constructing part or all of the device payload casing from a material that contributes to the screening effect of the device.

Accordingly, the present invention provides an obscurant device comprising an obscurant payload, a detonator, a burster charge which is initiated by action of the detonator and which is capable of disseminating said payload and a payload casing wherein some or all of the payload casing is configured to disintegrate upon actuation of the burster charge and to act thereafter as an obscurant.

Usefully the payload casing can be configured to provide effective electromagnetic screening in the millimeter waveband by constructing the casing out of a conductive carbon fibre. In this context effective millimeter wave attenuation is taken to be ≧10 dB (≦10% transmission) for a single pass through an obscurant cloud.

Suitable fibre types for construction of the casing include:

i) UTS carbon fibre, a PAN (poly-acrylo-nitrile) based carbon fibre which has a Young's Modulus (YM) of 230 Gpa;

ii) Nickel coated carbon (Ni—C), a PAN based carbon fibre with a YM similar to UTS;

iii) UD cloth carbon (UD-C), a unidirectional non-crimp material using carbon with a YM=230 Gpa;

iv) J-UTS carbon fibre, similar to the UTS fibre above but with a higher strain to failure;

v) P100s carbon fibre, a pitch based carbon fibre with higher electrical conductivity than that observed for PAN-based fibres;

vi) Ultra-high Modulus (UMS) carbon fibre, a high modulus PAN-based carbon fibre.

It was found in tests that highest mean attenuation in the measured millimeter wavelengths was achieved when the casing was made from VMS carbon fibre.

In order to achieve attenuation at the required frequencies the conductive casing should disintegrate into fibre lengths in the range of 1 mm to 10 mm. This is because the level of attenuation is maximised when the fibre-length is approximately a half-wavelength. For example, at 94 GHz (=3 mm) a fibre length of 1.5 mm is required.

Furthermore, manufacture of the payload casing can conveniently be achieved by dry filament winding as described more fully hereinafter. The Applicant has found that manufacture of the payload casing by the above technique using commercially available carbon fibre naturally results in a structure that disintegrates upon detonation into individual fibres suitable for millimeter screening. Suitable carbon fibre can be obtained from, for example, the following companies Tenax Plastics Limited, Akzo, Amoco, Courtaulds and Roskill.

Conveniently, the device can carry a mixture of obscurants as payload in order to result in screening at multiple wavebands. For example, if the device carries a brass flake/red phosphorous payload then, in addition to the millimeter screening effect generated by the disintegrating payload casing, the device also screens in the infrared and visual wavebands.

A device as described above can conveniently be adapted for use as a munition or as a decoy flare for deployment from an aircraft or a ship. At present aircraft and ships use different infra-red and radar decoys. For use in aircraft the device described above would be loaded with a magnesium/teflon/viton (MTV) payload and for naval uses a payload of red phosphorous would be appropriate.

Figure 2:
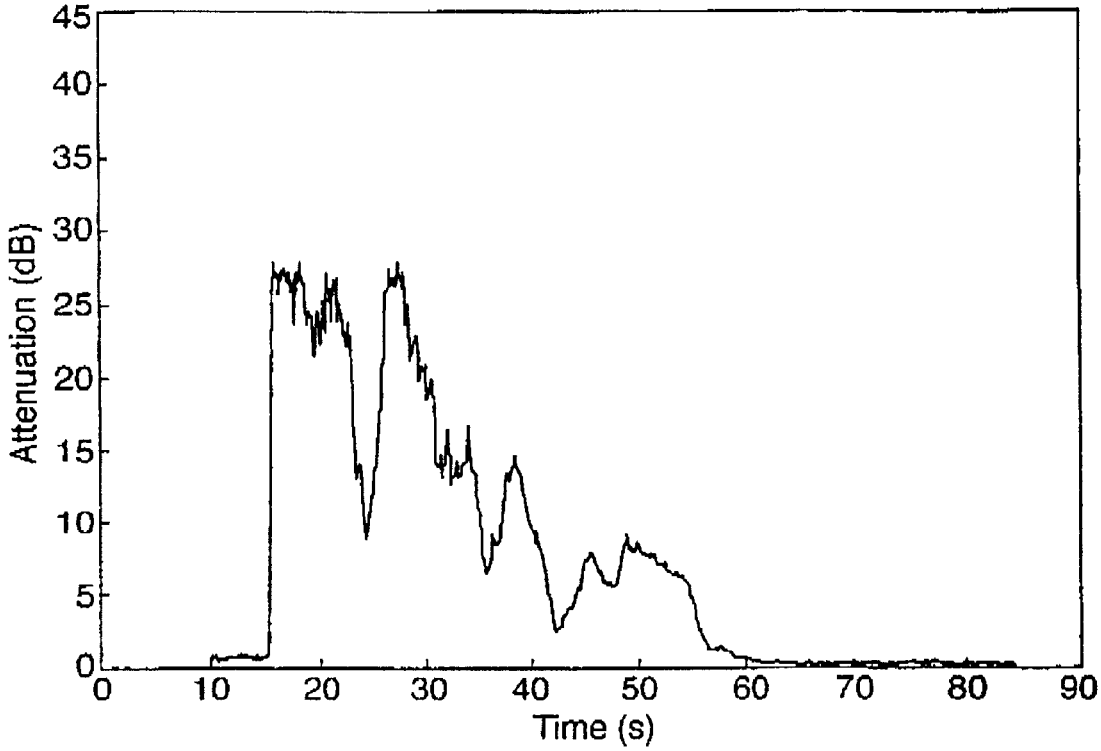

An embodiment of the present invention will now be described, by way of example, with reference to the accompanying drawings, wherein FIG. 1 shows a cross-section of a device design according to the invention FIG. 2 shows attenuation against time plot for the attenuation of the K Band (35 GHz) radiation for trial 1 (wind speed conditions <2 $msh^{-1}$).

Figure 3:
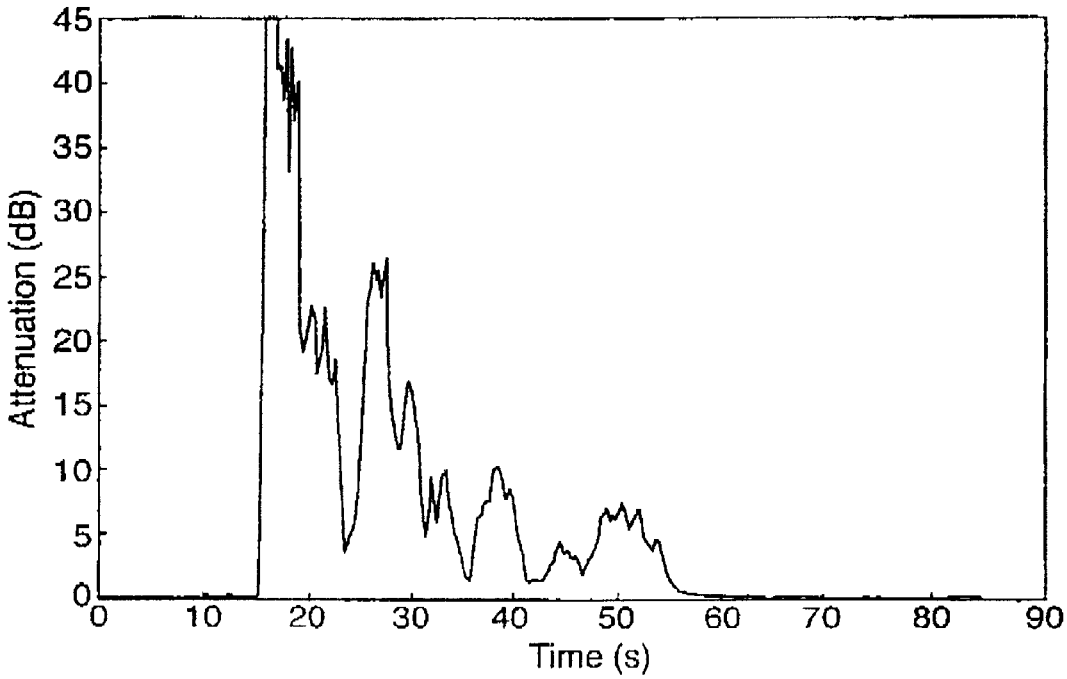

FIG. 3 shows attenuation against time plot for the attenuation of the M Band (94 GHZ) radiation for trial 1.

Figure 4:
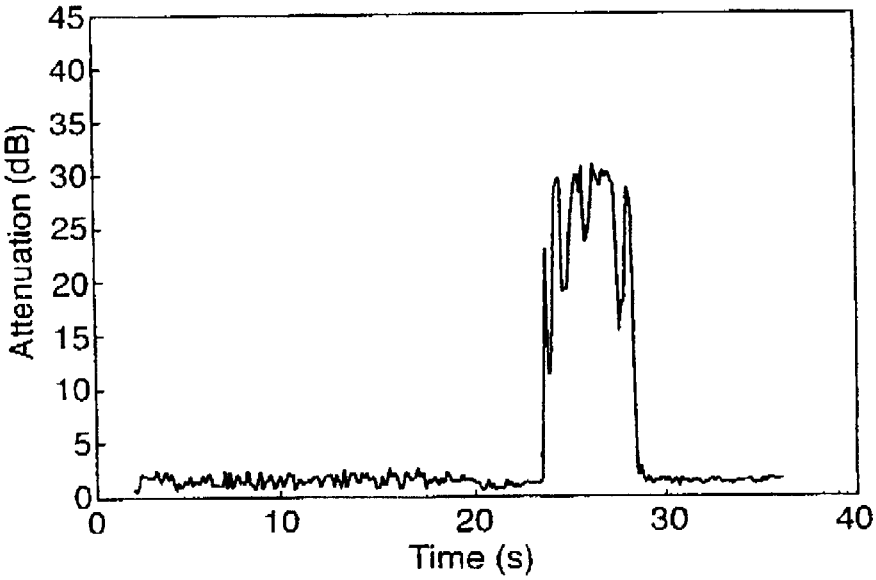

FIG. 4 shows the same attenuation versus time plot as FIG. 2 but for trial 2 (wind speed conditions between 7 $ms^{-1}$ and 9 $ms^{-1}$).

Figure 5:
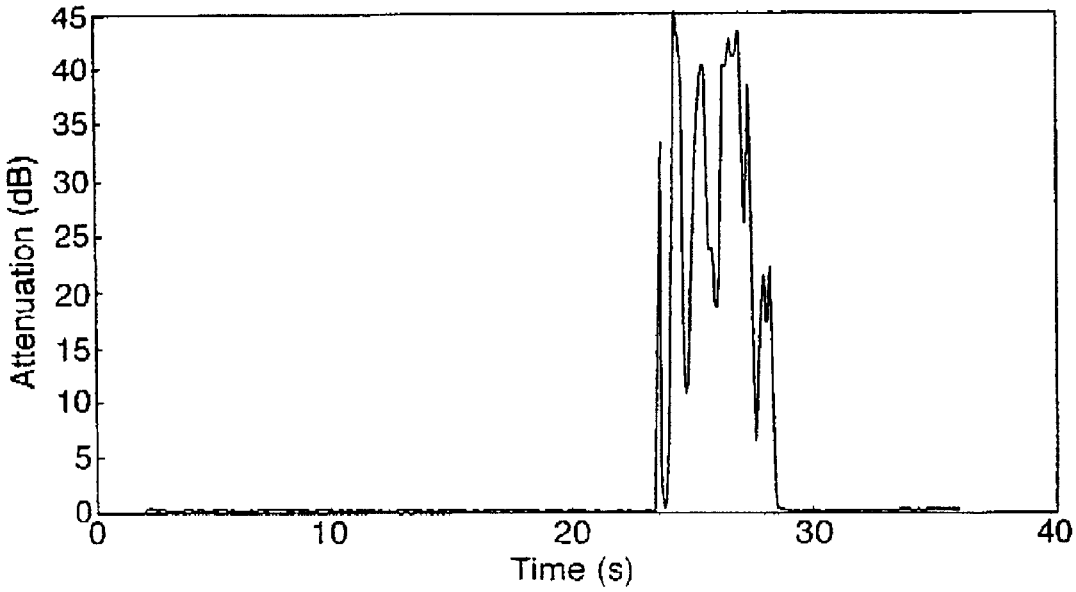

FIG. 5 shows the same waveband versus time plot as FIG. 3 but for trial 2.

Figure 6:
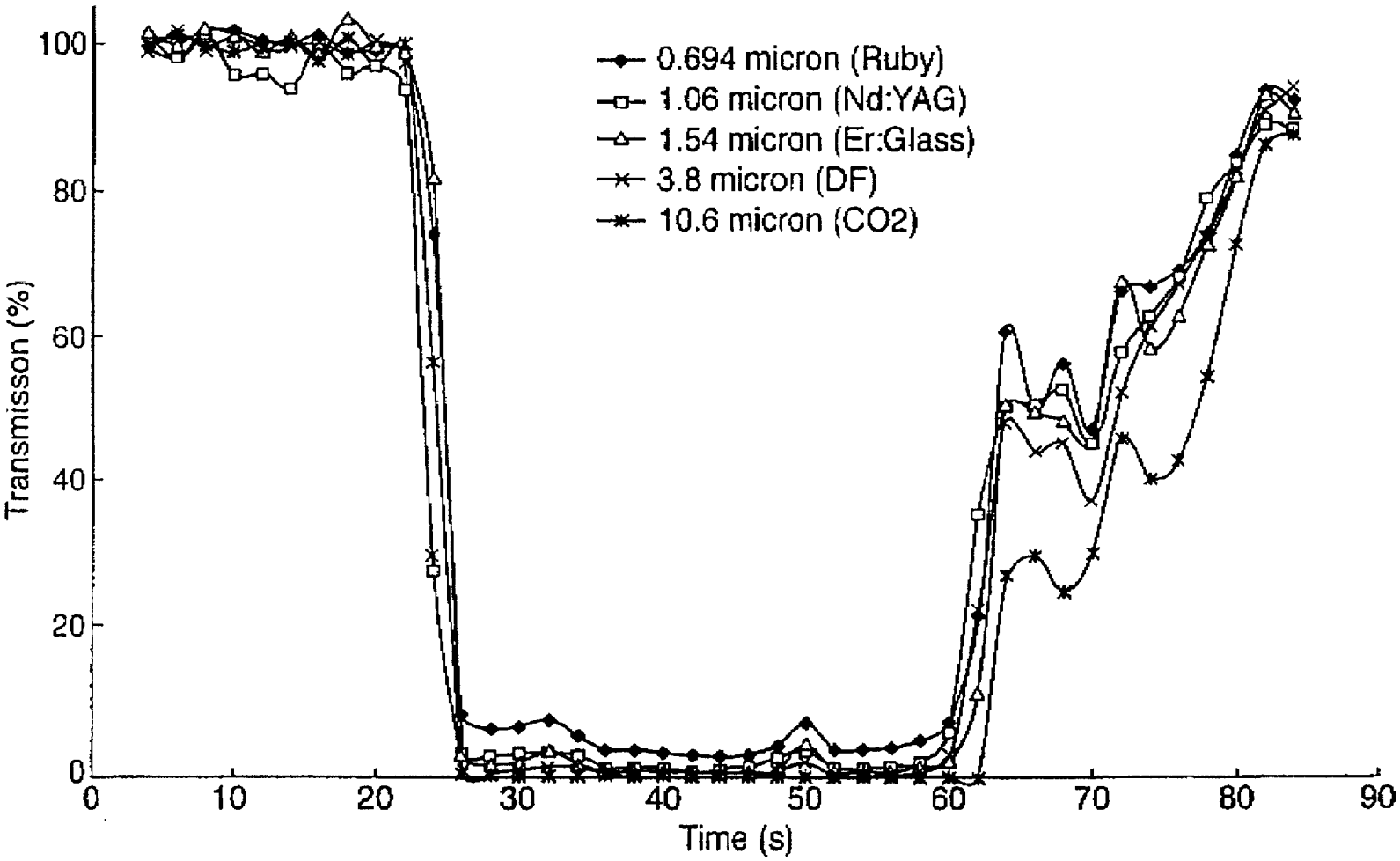
Figure 7:
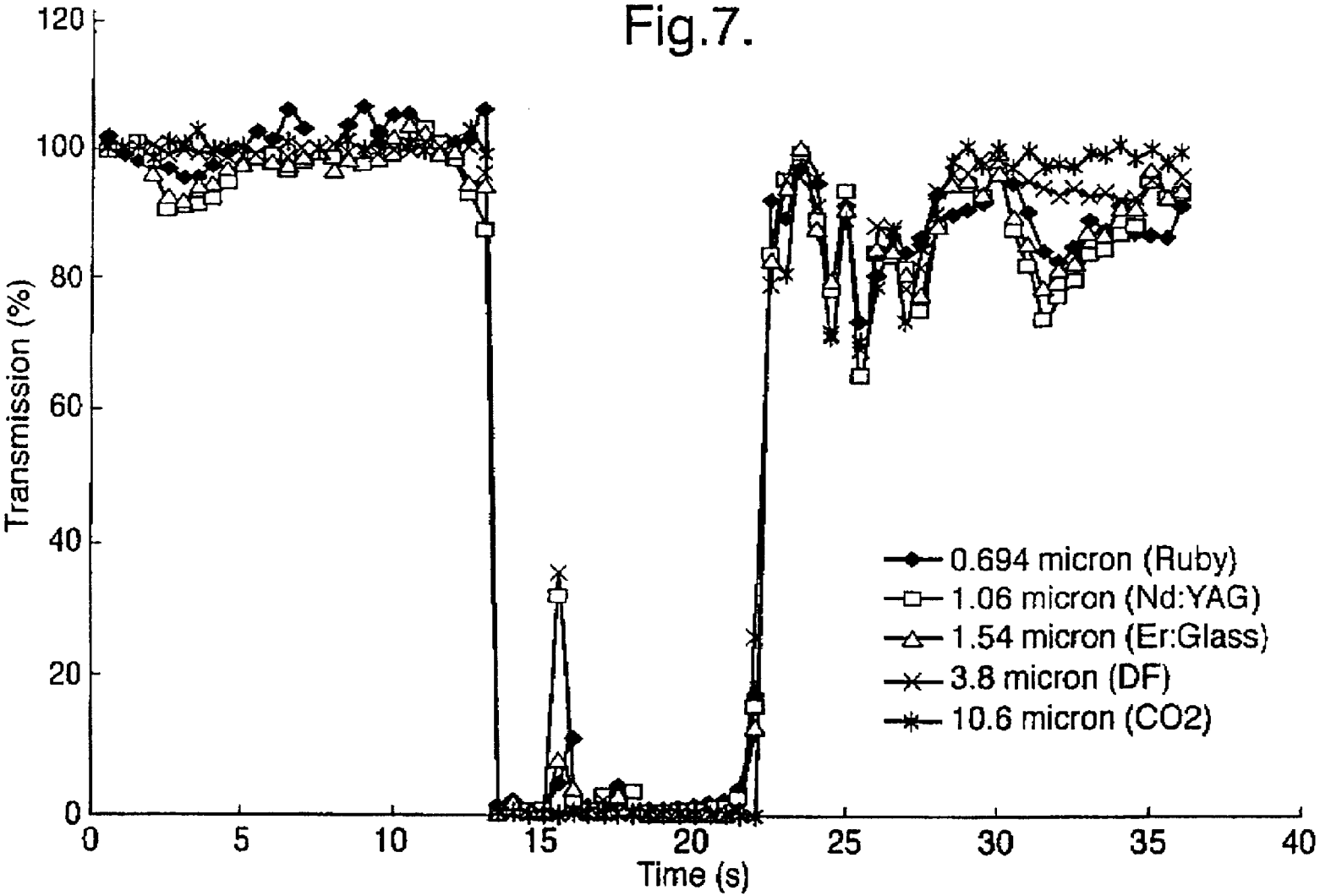

FIGS. 6 and 7 show the transmission against time at 5 specific wavelengths in the visual and infra red wavebands for trials 1 and 2 respectively.

Referring now to FIG. 1. This figure shows a cross section through typical multi spectral obscurant device 10. In this embodiment the payload, brass flake 20, is contained within a spool 30 sealed with end caps 31, 32. The end caps 31, 32 have apertures through which tube 33 is fitted along the axis of the spool 30. Tube 33 is sealed to the end caps 31, 32 and to the spool 30 and contains high explosive pellets 40 comprising <95% RDX (Hexahydro-1,3,5-trinitro-1,3,5-triazine), such as Debrix High Explosive pellets as manufactured by Royal Ordnance. A detonator 60 is located at one end of tube 33 and is connected to a fuze or firing box (not shown) by leads 61.

The conductive UMS carbon fibre case 50 surrounds the spool and is added by dry filament winding (The process of dry filament winding involves winding the fibre off a reel, at a set fibre tension. The fibre is then passed through a winding eye and is finally wound onto a bobbin, i.e. in this case the spool). During construction of the payload the fibre is initially wound onto itself a number of times in order to anchor itself to the spool. A pre-programmed is winding program is then run until the desired mass is deposited onto the spool. The free end of the fibre is then bonded to the deposited fibre by using an adhesive.

Alternatively the carbon fibre case 50 could be constructed separately. The components of the obscurant device 10 could then be assembled and the payload loaded into the device.

In operation, an electric pulse from a fuze or firing box initiates the detonator 60. The exploding detonator 60 produces a shock wave which detonates the high explosive pellets 40. The detonation of the high explosive pellets 40 disseminates the payload, brass flake 20, and also causes the carbon fibre case 50 to disintegrate and to act thereafter as a millimeter waveband obscurant.

During trials carried out on the obscurant device over 55 devices were tested. In all cases the conductive fibre casing had a diameter of 66 millimeters and was 160 millimeters in length. The particular carbon fibre used had a diameter of 7 microns. On average the total weight of the device with the carbon fibre casing was 1157 grams (this value varied from around 1100 to 1200 grams across the tested devices). The average weight of carbon fibre casing was 159 grams (this value varied between 99 and 183 grams). Twelve Debrix pellets were used as the burster charge.

FIGS. 2 to 7 represent results which are typical of all the tested devices and as can be seen from FIGS. 2 to 5 the carbon fibre casing generates an efficient obscurant field in the millimeter wavebands.

Turning to FIG. 2 it can be seen that significant attenuation of the K band is achieved almost immediately following device detonation. Over 20 dB attenuation is recorded for the first ten seconds. This drops to around 8 dB for a few seconds before returning to 20 dB for another five seconds. FIG. 3 shows that a screen of over 40 dB was initially formed in the M band and that this screen reduced to around 15 dB after eight seconds. It is therefore clear that significant attenuation within the millimeter waveband is achieved under low wind speed conditions by using the invention.

Turning to FIGS. 4 and 5 it can be seen that even under higher wind speed conditions an obscurant cloud capable of attenuating along the line of sight is generated.

Effectiveness of the generated visual/infrared obscurant cloud is not compromised by using the casing to generate the millimeter obscurant field. This can be ascertained by examination of the visual and infrared transmission data as detailed in FIGS. 6 and 7. It can be seen that transmission at each of the five wavelengths monitored is immediately reduced to low levels once the device detonates. Effective obscuration varies from 8 to 30 seconds depending on the wind conditions (i.e. high wind to low wind speed).

Further embodiments of the invention can be envisaged wherein different obscurant materials are used as the payload, i.e. red phosphorous or magnesium/teflon/viton (MTV).

What is claimed is:

1. An obscurant device comprising an obscurant payload, a detonator, a burster charge which is initiated by action of the detonator and which is capable of disseminating said payload and a payload casing wherein some or all of the payload casing is configured to disintegrate upon actuation of the burster charge and to act thereafter as an obscurant.

2. The obscurant device as claimed in claim 1 wherein some or all of the payload casing disintegrates upon detonation to form a millimeter waveband obscurant.

3. The obscurant device as claimed in claim 2 wherein the payload casing is made of a conductive carbon fibre.

4. The obscurant device as claimed in claim 3 wherein the conductive fibre is selected from the group consisting of UTS, Ni—C, UD-C, J-UTS, P100s and Ultra-high modulus carbon fibre.

5. The obscurant device as claimed in claim 4 wherein the payload casing is made of Ultra-high modulus carbon fibre.

6. The obscurant device as claimed in claim 2, wherein the payload casing disintegrates upon detonation into fibre lengths of between about 1 mm and about 10 mm.

7. The obscurant device as claimed in claim 3, wherein the payload casing is constructed by carbon fibre winding.

8. The obscurant device as claimed in claim 3, wherein the carbon fibre has a diameter of about 7 microns.

9. The obscurant device as claimed in claim 1 wherein the obscurant payload is capable of providing obscuration at visual wavelengths.

10. The obscurant device as claimed in claim 9 wherein the obscurant payload comprises red phosphorous.

11. The obscurant device as claimed in claim 1 wherein the obscurant payload is capable of providing obscuration at infrared wavelengths.

12. The obscurant device as claimed in claim 11 wherein the obscurant payload includes brass flakes.

13. A screening decoy flare suitable for deployment from an aircraft comprising an obscurant device as claimed in claim 1 carrying a payload of magnesium/Teflon/viton.

14. An obscurant device as hereinbefore described with reference to the accompanying drawings.

15. An obscurant device comprising an obscurant payload, a detonator, a burster charge which is initiated by action of the detonator and which is capable of disseminating said payload, and a payload casing having a substantial portion configured (i) to disintegrate upon actuation of the burster charge and (ii) thereafter to act as an obscurant providing effective screening in at least part of the electromagnetic spectrum.

16. An obscurant device according to claim 15 in which the disintegrable portion of the payload casing disintegrates upon actuation of the burster charge into a plurality of pieces having length approximately one-half wavelength of a part of the electromagnetic spectrum effectively screened.

* * * * *